United States Patent [19]

Gyenge et al.

[11] Patent Number: 4,844,467

[45] Date of Patent: Jul. 4, 1989

[54] CHANCE SELECTION DEVICE

[76] Inventors: Michael Gyenge, 575 Blanchard Crescent, Ottawa, Ontario, K1B 7V7; Robert E. Gray, Apt. #4, 72 Pretoria Avenue, Ottawa, Ontario, K1S 1W9, both of Canada

[21] Appl. No.: 221,616

[22] Filed: Jul. 20, 1988

[51] Int. Cl.[4] ..... A63F 9/08; A63F 9/18

[52] U.S. Cl. ..... 273/161; 273/138 R; 273/153 S

[58] Field of Search ..... 273/138 R, 153 S, 161

[56] References Cited

U.S. PATENT DOCUMENTS 4,496,155 1/1985 Goldfarb ..... 273/153 S

*Primary Examiner*—Anton O. Oechsle

*Attorney, Agent, or Firm*—Burke-Robertson

[57] ABSTRACT

A hand-manipulatable three-dimensional device for generating and displaying groups of symbol combinations selected in pseudo-random sequence, having relatively movable faces, each of the faces bearing one of the two distinguishing symbols. A stand, on which the unit may be mounted, permits reading of the faces at selective orientations of the device. The device may be used as a parlor game or the like.

15 Claims, 3 Drawing Sheets

CHANCE SELECTION DEVICE

The present invention relates to a hand-manipulatable three-dimensional device for generating and displaying groups of symbol combinations selected in pseudo-random sequence, for use as a parlour game or the like.

BACKGROUND OF THE INVENTION

Three-dimensional combination toys or puzzles, in which different combinations of colours or pictures or numbers may be produced by moving blocks in three dimension, are known. The ultimate aim of these amusement devices is common, namely, to manipulate the plurality of elements to different positions in an attempt to reproduce a predetermined pattern. Puzzles, with similar purposes, have been invented with various overall shapes.

For example, the popular Rubik's Cube® is in the form of a cube consisting of a plurality of manipulatable cubical elements which by rotation can be moved to different positions, the object being to reproduce the original pattern of cubical facets on all six faces of the cube.

Another form of hand-manipulatable three-dimensional puzzle is described and illustrated by Goldfarb U.S. Pat. No. 4,496,155 issued Jan. 19, 1985; including a body in the shape of an octahedron and constituted of a plurality of elements interconnected together to permit rotation of one-half of the body with respect to the other half along each of three orthogonal planes symmetrically passing through the body. The octahedron-shaped body is defined by a pair of interpenetrating tetrahedra presenting the outline appearance of a six-pointed star when the device is viewed along any one of the eight axes of the tetrahedra. The eight smaller tetrahedra, which define the outer face of the puzzle, may be manipulated to different positions with the aim of reproducing a predetermined pattern.

One possible internal mechanism which permits relative movement of the elements of the three-dimensional puzzles is taught in Isobe U.S. Pat. No. 4,344,623 issued Aug. 17, 1982. his mechanism comprises a central, spherical core and a plurality of guide canopies laterally spaced apart from one another such that the spaces between the edges of adjacent guide canopies define guide tracks. Seven movable elements are provided (each provided with a slide piece dimensioned to slide within and be retained by the canopies and guide spaces and attached to its element via an inwardly projecting slide leg free to move within the guide tracks), as well as an eighth, fixed element fastened to the central core. The guide canopies may first be attached to the central core; the seven movable blocks may then be assembled with their respective slide pieces inserted into the guide spaces via a slide piece insertion opening, and finally the fixed element may be fastened to the central core above the slide piece insertion opening.

Other patents of general background interest describing and illustrating hand-manipulatable toys or puzzles, include U.S. Pat. No. 3,081,089 Gustafson issued Mar. 12, 1963, U.S. Pat. No. 3,655,201 of Nichols issued Apr. 11, 1972 and U.S. Pat. No. 4,407,502 of Paulos issued Oct. 4, 1983.

Despite the various applications of such known three-dimensional toys and puzzles, there is no known chance selection application of such devices. It is therefore an object of the present invention to provide a parlour game for entertainment by generating and displaying groups of symbol combinations selected in pseudo-random sequence and by permitting the "reading" of the symbol combinations of the adjacent faces of the device with the purpose, for example, for predicting one's fortune or the like

SUMMARY OF THE INVENTION

In accordance with the present invention there is provided a hand-manipulatable three-dimensional device for generating and displaying groups of symbol combinations selected in pseudo-random sequence. The device comprises an octahedral unit formed of a plurality of elements having equilateral congruent triangular faces. The elements are interconnected together to permit rotation of one-half of the unit with respect to the other half along each of the three orthogonal planes of symmetry of the unit. The elements are grouped about and enclose a center sphere with their triangular faces facing outwardly. Seven of the elements are movable on the outer surface of the sphere, with the eighth element being secured to the sphere. To the centre of the triangular face of each element a tetrahedron segment is rotatably secured at the centre of its base. The base of each tetrahedral segment is of similar size and shape to the triangular faces of the elements of the unit. Each of the tetrahedral segments has an outwardly directed apex and three outer faces. The three outer faces of each tetrahedral segment meet at the apex at right angles. Each of the faces of the tetrahedral segments bears one of two distinguishing symbols to provide clear visual alignment or misalignment with the corresponding marking on the corresponding face of an adjacent tetrahedral segment on an adjacent element. A stand is provided, having a base and upstanding arms spaced from each other on the base. At the upper ends of arms means are provided to hold therebetween the apexes of oppositely positioned segments on the unit to permit rotation of the unit on the axis passing through said opposite apexes, whereby the alignment or misalignment of the symbols on corresponding pairs of faces of the segments when viewed along the facing outer vertex of each of progressive segments may be visualized.

In a preferred embodiment axially aligned sleeve means are secured to the upper ends of the arms of the stand. Facing ends of the sleeve means receive the outer apexes of oppositely positioned segments on the unit to permit rotation of the unit with respect to the stand. Also, the sleeve means are provided with stop means to releasably hold the unit in position, against unintended rotative motion, at predetermined rotative positions 60° apart, so that when the unit is rotated to each of said positions, the unit is positioned for viewing the faces of the segment of the facing apex and the adjacent faces of the segments adjacent thereto.

A pair of linear markings are provided on the base of the stand. Each of such markings are oriented so as to direct the alignment of the stand relative to the user. Each of the linear markings relate to the viewing of three different set of faces, one on each of three segments, adjacent to the three faces of central segments adjacent thereto.

The device according to the present invention by permitting the "reading" of the groups of symbol combinations as displayed by symbols of the adjacent faces of the segments, may be used as a parlour game for example for predicting one's fortune or the like.

BRIEF DESCRIPTION OF THE DRAWINGS

These and other objects and advantages of the invention will become apparent upon reading the following detailed description and upon referring to the drawings in which.

Figure 1:
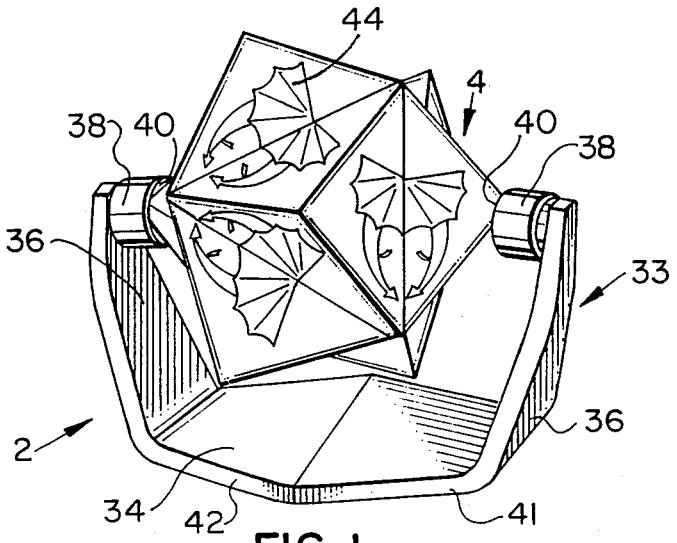
FIG. 1 is a perspective view of the device in accordance with the invention, in position for viewing by a user.

While the invention will be described in conjunction with an example embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE INVENTION

In the drawings, similar features have been given similar reference numerals.

Figure 2:
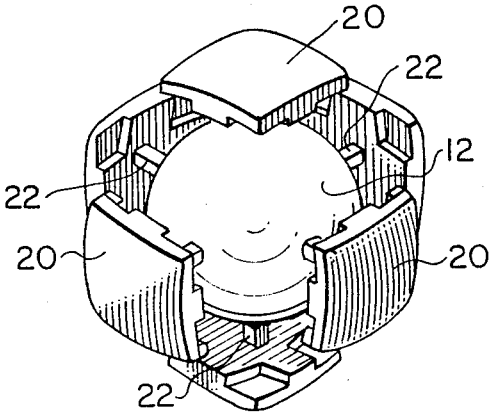
FIG. 2 is a partial exploded view of the octrahedral unit and tetrahedral segments of FIG. 1, illustrating the interconnection of the parts thereof.
Figure 3:
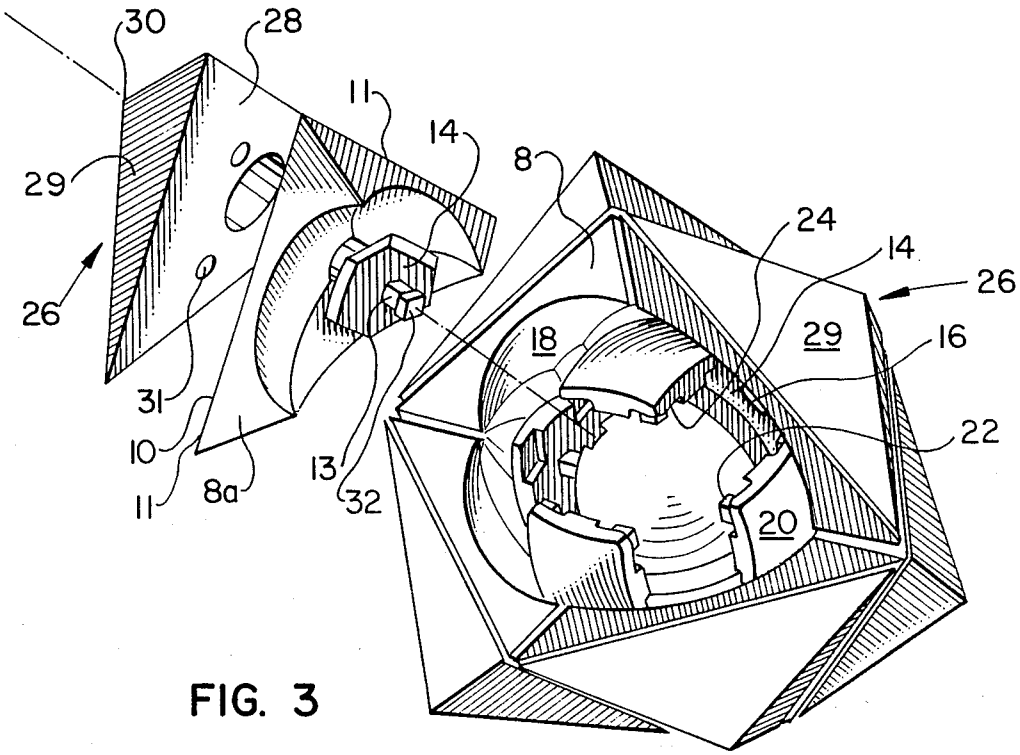
FIG. 3 is a perspective view of the central core part of the octrahedral unit of FIG. 2.

Turning to the drawings, there is illustrated in FIG. 1 a device 2 in accordance with the present invention. Device 2 comprises a hand-manipulatable pseudo-random selection unit 4 rotatably mounted on a stand 33. Unit 4 as can be seen in FIG. 3 is made of a plurality of elements 8 having flat, equal-sided triangular outer faces 10 and slidably mounted on a central spherical core 12 (FIG. 2) to form an octrahedral unit having adjacent equilateral congruent triangular faces. Elements 8 are interconnected together, as illustrated, to permit rotation of one-half of the unit with respect to the other half along each of the three orthogonal planes of symmetry passing through the center of the unit. Seven of elements 8 thus are slidably movable on the outer surface of core 12 while the eighth element (8*a*) is secured to the core, post 13 locking into an aperture (not illustrated) in core 12, element 8*a* being not movable with respect thereto. In this way, the three edges 11 of the fixed element 8*a* define the three allowable directions of relative rotation for the remaining seven elements 8 about core 12 and also provide the necessary guidance during their rotation. Each plane of symmetry divides the elements 8 into two groups of four. This permits one-half of the unit to be rotated with respect to the other half along each of these three planes of symmetry.

Movement of the seven movable elements 8 on the spherical surface of core 12 is permitted and guided by means of triangular feet 14, of part-spherical contour, mounted centrally by means of posts 16 to the underside 18 of each of such element 8, feet 14 being slidable on the surface of core 12 and held there by means of umbrella sections 20 spaced from each other and from the surface of core 12. Umbrella sections 20 are mounted thereon by central shaft 22. The shape of the underside of each umbrella section 20 is that of a sphere of radius slightly less than (r +e) where r is the radius of the core 12, and e is the thickness of the feet 14, while the outside of the umbrella section 20 is also spherical of radius slightly less than (r +e +t) where t is the thickness of the umbrella section. When the umbrella section 20 is projected onto a flat surface at right angles to the shaft 22 it is square-shaped.

The shoulder of thickness e permits a predetermined guide space to be formed between each umbrella section 20 and the central core or sphere 12.

The spaces between umbrella sections 20 receive and guide posts 16 of movable elements 8, and are oriented to ensure proper directional movement of these elements.

By holding four of these elements 8 and 8*a* in one hand, the other four can be moved into one of four possible positions corresponding to the positions where each triangular element 8 is perfectly aligned with its three adjacent triangular elements. In each of these positions, any one of the three possible axes of rotation can be chosen and the unit will be free to rotate. A difficulty arises if the unit is left in some intermediate position which may be close to one of the four desired positions but not right on it. If a new axis of rotation is chosen, great difficulty will be experienced in moving the unit elements. Should undue force then be used, destruction of the unit could then ensue. To avoid this problem, corner depressions 24 are provided on the inner surfaces of umbrella sections 20 to form four definite click stops to receive therein corner portions of feet 14 and signal when their correct position has been reached. Alternatively depressions may be provided on the upper surface of each corner of the feet 14 which are designed to be occupied by the corners of the umbrella sections 20 when the correct position has been reached in a given rotation. The springy character of the umbrella sections 20 allows them to snap into these depressions whenever appropriate alignment of feet 14 and umbrella sections 20 is achieved.

Secured to outer face 10 of each element 8 is a tetrahedrally-shaped segment 26 having a base 28 which is triangular in shape and congruent with outer face 10. Each of these segments 26 has three outer faces 29 and an apex 30 in the form of a truncated corner of a cube forming a tetrahedron standing on an equilateral triangle with the edges meeting at the apex 30 being mutually orthogonal. Each of these outer tetrahedral segments 26 is centrally rotatably mounted on the outer face 10 of its respective triangular element 8. This adds greatly to the number of permutations and combinations possible.

In a preferred embodiment of the invention each of the twenty-four faces 29 available for segments 26 is marked with one of two different symbols. The first symbol may, for example, be a design in the form of the tail of a dragon with its tail towards the right (R). The second symbol is a mirror image of the first symbol so that the tail of the dragon points towards the left (L). The eight outer tetrahedral segments each with their three faces are then marked with the following symbols.

| | | |
|---|---|---|
| R | R | R |
| R | R | L |
| R | L | R |
| R | L | L |
| L | R | R |
| L | R | L |
| L | L | R |
| L | L | L |

When one face of a tetrahedron with an R symbol comes into conjunction with another tetrahedron face also with an R symbol, then two distinct dragons' tails are observed. On the other hand, if a R and L symbols are in conjunction then the head of an oriental person is seen. This scheme provides a method whereby the symbols formed after pseudo-random manipulations of the invention, can be interpreted in terms of heads and tails.

Another problem arises when the outer tetrahedra are allowed to rotate about axes through their vertexes. If one of these tetrahedral segments 26 is left so that the vertexes overhang any of the adjacent segments 26, there is a possibility that damage could result if the rotation of one group of four elements 8 with respect to the other four are attempted. To avoid this, three click stops in the form of projections 31 are provided on the base of each segment 26, to be releasably seated in corresponding indentations in the triangular face 10 of the corresponding element 8 when in proper alignment, so that the operator knows for sure that the outer segment has been left in the correct position.

To assemble the unit, first the six umbrella sections 20 are secured to core 12. The movable inner elements 8 have triangular-shaped feet 14. It is possible to insert these feet into the spaces between any three of the umbrella sections 20 and with a slight twist, slide it into place around the core 12. Element 8*a* has a foot 14 of more rounded shape because it is not possible to twist this last element, so that it is retained under each of the three corresponding umbrella sections 20. The eighth element 8*a* is simply dropped into place and secured to core 12 by square-shaped snap pin 32 at the end of post 13 to both hold it and prevent it from rotating.

In operation, the elements 8 are rotated through any of the three axes of rotation, any number of times. As well, each outer tetrahedral segment 26 can be rotated about an axis through its own vertex. As a random permutation device, for a given combination, the invention gives the same probability as would occur if three coins were thrown six times.

For operation and viewing of the unit 4, a stand 33 having a base 34 and spaced, upstanding arms 36 is provided. At the upper ends of arms 36 are a pair of inwardly oriented, aligned sleeves 38, secured to the arms 36. Apertures 40, adapted to releasably hold the apexes 30 of oppositely positioned segments 26 to permit rotation of the unit 4 on the axis passing through these apexes 30, are provided in the facing ends of sleeves 38. When all manipulations on the unit 4 are finished, the unit 4 is placed on stand 33 to facilitate reading. The apexes of two opposing tetrahedral segments 26 chosen are inserted into apertures 40 of sleeves 38. With two of the tetrahedral vertexes 30 being used as pivot points, six vertices are left around which readings may be made. Each of these vertices is associated with a tetrahedron which in turn is surrounded by three faces of three other tetrahedrons. By interpreting the patterns formed by these conjunctions, one can get the same effect as if one were to toss three coins six times.

The sleeve mounts 38 on the stand arms 36 are formed with click stops (not illustrated) every 120°, the click stops on each sleeve being 60° out of phase with those on the other. By rotating the unit 4 through to the next click stop on the right hand side, a new central tetrahedron segment 26 is seen surrounded by the faces 29 of three adjacent tetrahedron segments 26. This gives rise to a new set of heads and tails. A third rotation of unit 4 in its stand 33 brings a third tetrahedron segment 26 into view and a third set of heads and tails can be found. If the unit 4 is now rotated 60°, the right hand sleeve 38 will click into a stop position. If the entire stand 33 is now slightly turned clockwise on its base 34, a fourth central tetrahedron segment 26 will be viewed and a fourth set of heads and tails determined. A 120° rotation of the unit 4 in its stand 33 will reveal a fifth tetrahedron segment 26 while rotation to a sixth click stop position will give the remaining set of heads and tails.

Figure 4A:
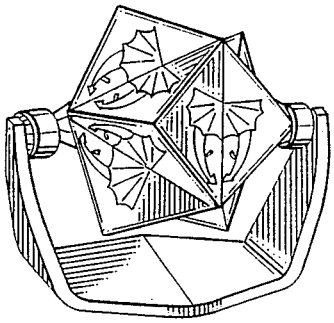
FIGS. 4*a*, 4*b*, 4*c* and 4*d* are schematic views of the device of FIG. 1 illustrating its manner of operation.
Figure 4B:
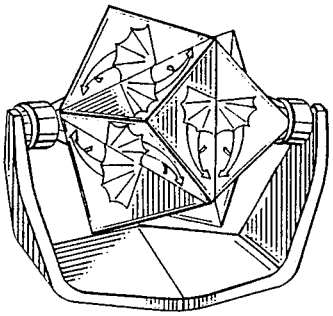

In this regard, to illustrate to the user the proper orientation of the stand 33 for viewing each of these two sets of three central tetrahedra and surrounding faces of adjacent tetrahedra, an appropriate stand alignment means in the form of linear markings is provided. In the illustrated embodiment, this alignment means is provided by the orientation of edges 41 and 42 of base 34. These edges are formed so that when one or the other directly faces the user, the stand (and unit 4 held within) are properly positioned so that the user has a direct view of one or the other of these sets of tetrahedra. As an example of the use of this device, symbols 44 representing, as previously discussed, when aligned on adjacent faces on adjacent tetrahedra, a "face" is formed on the tetrahedra faces as illustrated in FIG. 1, and when not aligned on adjacent faces of adjacent tetrahedra, the tails of a dragon, may be provided on the tetrahedra faces as illustrated in FIGS. 4*b* and 4*d*. The symbols would be arranged on the faces 29 as previously indicated herein.

In order to use the device one may formulate a question about a matter one has been thinking of for some time. The unit is then removed from stand 33 and manipulated by that person by rotating through any of its three rotational directions for any number of times. In addition, any of the eight tetrahedra can be rotated on its own axis. The unit is then returned to its stand with a pair of opposite apexes positioned in apertures 40 of sleeves 38. The device is then ready to be read.

Starting from the point where the unit 4 has been returned to the stand, the stand is first turned slightly so that edge 42 is directly in front of the user. The unit 4 is then rotated slightly in the stand until it clicks into detente on the left hand sleeve of the stand. (At this stage, the right hand sleeve with the stand will be out of detente.) The first pattern is read from the pattern which is directly in front of the user. A typical pattern is shown in FIG. 4*a* where it can be seen that, in the example shown, three heads are visible corresponding to $3+3+3=9$ (where a "head" is given a represented value of 3, a "tail" a value of 2).

To obtain a second reading, the unit 4 is rotated until it clicks into the next detente, making sure that the base of the stand does not move. A second pattern can now be determined from the new pattern in front of the user. In the case of the example in FIG. 4*b*, the pattern consists of two tails and one head or $2+2+3=7$. A third rotation of the unit 4 towards the user without moving the base, until it clicks into the next detente on the left hand sleeve of the stand gives the view from which the value of the third pattern can be determined.

Figure 4C:
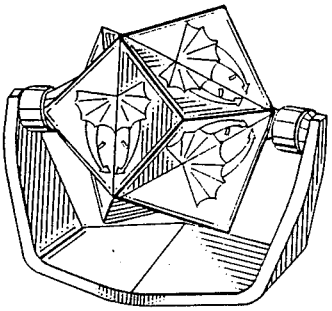
Figure 4D:
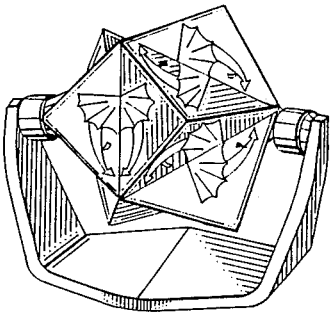

In order to get fourth, fifth and sixth patterns, the stand 33 must now be turned until the edge 41 on the base is squarely in front of the user (see e.g. FIGS. 4*c* and 4*d*). The particular view in front of the user will correspond to the fourth pattern and is read in the way described above. A rotation of the unit 4 in its stand until it clicks into the next detente position will give the fifth pattern while a final rotation of the unit into its third detente position on the right hand side of the stand will give the pattern corresponding to the sixth pattern.

The values of these patterns may then be correlated with interpretation charts, which would provide, for example, predictions concerning the user's future or the like.

Thus it is apparent that there has been provided in accordance with the invention a hand-manipulated three-dimensional device for generating and displaying groups of symbol combinations selected in pseudo-random sequence that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What we claim as our invention:

1. A hand-manipulatable three-dimensional device for generating and displaying groups of symbol combinations selected in pseudo-random sequence comprising an octahedral unit formed of a plurality of elements having equilateral congruent triangular faces, the elements interconnected together to permit rotation of one-half of the unit with respect to the other half along each of the three orthogonal planes of symmetry of the unit, the elements grouped about and enclosing a center sphere with their triangular faces facing outwardly, seven of the elements being movable on the outer surface of the sphere, the eighth element being secured to the sphere, the edges of which define the allowable directions of rotation of the other elements about the sphere and guide those elements during rotation, to the centre of the triangular face of each of the elements a tetrahedral segment being rotatably secured at the centre of its base, the base of each tetrahedral segment being of similar size and shape to the triangular faces of the elements of the unit, each of the tetrahedral segments having an outwardly directed apex and three outer faces, the three outer faces of each tetrahedral segment meeting at the apex at right angles, each of the faces of the tetrahedral segments bearing one of two distinguishing symbols to provide clear visual alignment or misalignment with the corresponding symbols on the corresponding face of an adjacent tetrahedral segment on an adjacent element, a stand having a base and upstanding arms spaced from each other on the base, the arms having, on their upper ends, means located so as to hold therebetween the apexes of oppositely positioned segments on the unit to permit rotation of the unit on the axis passing through said opposite apexes, whereby the alignment or misalignment of the symbols on corresponding pairs of faces of the segments when viewed along the facing outer vertex of each of progressive segments may be visualized.

2. A device according to claim 1 wherein axially aligned sleeve means are secured to the upper ends of the arms of the stand, with open, facing ends of the sleeve means to receive the outer apexes of oppositely positioned segments on the unit and permit rotation of the unit with respect to the stand.

3. A device according to claim 2 wherein the sleeve means when combined with the geometry of the unit inserted between the arms of the stand, are provided with stop means to releasably hold the unit in position, against unintended rotative motion, at determined rotative positions 60° apart, so that when the unit is rotated to each of said positions, the unit is positioned for viewing the unit over the apex of each of the apexes of a set of segments so that the faces of that segment and the adjacent faces of the segments adjacent thereto may be seen at one time by the user.

4. A device according to claim 3 wherein the stop means for each of the sleeve means are 120° apart and in phase with respect to the stop means of the other sleeve means.

5. A device according to claim 1 wherein the base is provided with alignment means to permit orientation with respect to a user of the unit when held in position in the stand so that the user may align the stand and unit for viewing the unit over the apex of one of the segments so that the faces of that segment and the adjacent faces of segments adjacent thereto may be seen at one time by the user.

6. A device according to claim 5 wherein the alignment means comprise a pair of linear markings on the base of the stand, each of such markings oriented so as to direct the alignment of the stand relative to the user, each of the linear markings positioned to enable alignment of the stand for the viewing of a different set of three segments and the adjacent faces of segments adjacent thereto.

7. A device according to claim 5 wherein edges of the base form the linear markings.

8. A device according to claim 1 wherein the symbols on each face of a segment comprise a similar symbol which is elongated along the edge of that face which adjoins the edge of a face on an adjacent segment, the symbols designed and located on the faces so as to provide clear visual alignment or misalignment along that edge with the corresponding symbol on the adjacent face on the adjacent segment.

9. A device according to claim 8 wherein the combined effect of symbols on adjacent faces on adjacent segments is to represent a "head", when in linear alignment, or a "tail", when in linear misalignment.

10. A device according to claim 1 wherein the faces of eight tetrahedral segments are marked as follows:

| | | |
|---|---|---|
| R | R | R |
| R | R | L |
| R | L | R |
| R | L | L |
| L | R | R |
| L | R | L |
| L | L | R |
| L | L | L |

where R represents one of the distinguishing symbols and L represents the lateral inversion of R.

11. A device according to claim 1 wherein means are provided to releasably secure against unpurposeful disengagement the segments in predetermined positions attained by relative rotation thereof with respect to the elements of said positions such that corresponding edges of adjacent faces on adjacent segments are aligned when the segments are in said predetermined positions.

12. A device according to claim 1 wherein means are provided to releasably secure against unpurposeful disengagement the elements in predetermined positions attained by relative rotation thereof with respect to the elements of said positions such that corresponding edges of adjacent faces of the elements are aligned when the adjacent elements are in said predetermined positions.

13. A device according to claim 12 means are provided to releasably secure against unpurposeful disengagement the segments in predetermined positions attained by relative rotation thereof with respect to the elements of said positions such that corresponding edges of adjacent faces on adjacent segments are aligned when the segments are in said predetermined positions.

14. A device according to claim 1 wherein each of the movable elements is provided with a triangular foot of part spherical contour to correspond to that of the surface of the sphere, each of the feet being mounted centrally by post means to the underside of each of the elements, the feet being slidable on the surface of the centre sphere.

15. A device according to claim 14 wherein the feet are slidably held on the surface of the sphere by means of centrally mounted sections of parts spherical contour spaced from the surface of the sphere and held there by means of post means, these sections being spaced from adjacent sections between which the post means of the movable elements pass, with guidance being provided by the edges of the element fixed to centre sphere.

* * * * *